US006547537B2

(12) United States Patent
Olson

(10) Patent No.: US 6,547,537 B2
(45) Date of Patent: Apr. 15, 2003

(54) AIR OPERATED RADIAL PISTON AND DIAPHRAGM PUMP SYSTEM

(76) Inventor: Lawrence P. Olson, 18006 Pine Ave., Fontana, CA (US) 92335

( * ) Notice: Subject to any disclaimer, the term of this patent is extended or adjusted under 35 U.S.C. 154(b) by 0 days.

(21) Appl. No.: 10/117,729

(22) Filed: Apr. 5, 2002

(65) Prior Publication Data

US 2002/0168273 A1 Nov. 14, 2002

Related U.S. Application Data

(63) Continuation-in-part of application No. 09/715,132, filed on Nov. 20, 2000, now abandoned, which is a continuation-in-part of application No. 09/395,549, filed on Sep. 14, 1999, now abandoned.

(51) Int. Cl.[7] ..... F04B 17/00; F04B 35/02; F04B 45/06; F04B 1/04

(52) U.S. Cl. ..... 417/393; 417/383; 417/385; 417/395; 417/273

(58) Field of Search ..... 417/383, 384, 417/385, 389, 393, 395, 273

(56) References Cited

U.S. PATENT DOCUMENTS

| | | | | |
|---|---|---|---|---|
| 3,276,381 A | * | 10/1966 | Harklau et al. | 417/339 |
| 3,589,838 A | * | 6/1971 | Tuzson | 417/339 |
| 3,781,141 A | * | 12/1973 | Schall | 417/395 |
| 5,275,014 A | * | 1/1994 | Solomon | 62/324.1 |

* cited by examiner

*Primary Examiner*—Charles G. Freay
*Assistant Examiner*—Timothy P. Solak
(74) *Attorney, Agent, or Firm*—George J. Netter

(57) ABSTRACT

Three or more diaphragm pumps (12,14,16) are interconnected to sequentially receive an activation fluid from corresponding piston and cylinder pumps (18,20,22) synchronized by a control mechanism (24) which includes a distributor plate (42) with directive shallow slots (80,82,84) for conduiting activation fluid to a porting plate (44) and via openings (60,62,64) to the piston and cylinder pumps (18, 20,22).

7 Claims, 5 Drawing Sheets

14
16
20
22
62
24
70
72
64
60
68
18
38
26
12
32
28
34
30
36

FIG. 4
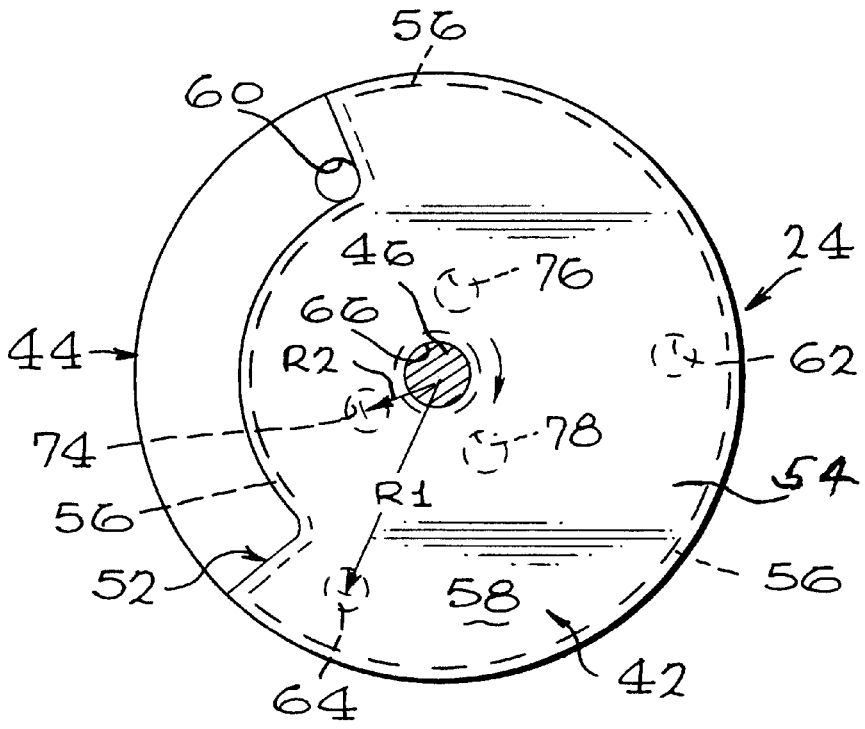
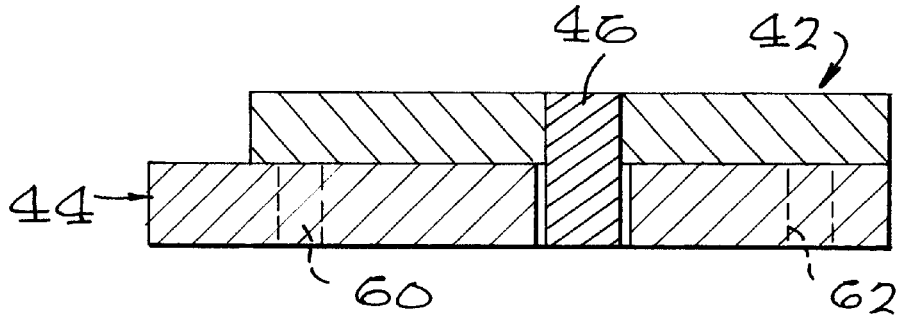
FIG. 5

8
E
90
7
86
104
100
96
E
7
80
R3
46
92
102
R4
106
84
82
94
E
98
8

42'
46
48
80
82
44
40'
R3
88
R4

46

AIR OPERATED RADIAL PISTON AND DIAPHRAGM PUMP SYSTEM

This is a continuation-in-part of Ser. No. 09/715,132 filed Nov. 20, 2000, abandoned, which was a continuation-in-part of Ser. No. 09/395,549 filed Sep. 14, 1999, abandoned.

BACKGROUND

1. Field of the Invention

The present invention relates generally to a multiple diaphragm pump system, and, more particularly, to a control mechanism for sequentially driving a plurality of diaphragm pumps in the system.

2. Description of Related Art

Diaphragm pumps are well known and typically include a pumping chamber containing a fluid to be pumped therein, which chamber also has a flexible wall or diaphragm that on contracting discharges the pumped fluid into and along a desired outlet conduit. Many dual-chamber diaphragm pumps also have a working chamber provided with a working fluid (e.g., air) that expands the working chamber and simultaneously reduces the pumping chamber due to the flexing of the diaphragm to effect pressurized discharging of the pumped fluid. Conventional one-way valves maintain desired direction of fluids during operation. Also, diaphragm pumps of this character typically require control apparatus for cyclically supplying working fluid to the pump and discharging the working fluid from the pumping chamber.

A known version of diaphragm pumping system has two dual-chamber diaphragm pumps with a control mechanism that charges the working chamber of one diaphragm pump while venting the other pump. Such systems undesirably exhibit an "over-center" problem characterized by the tendency of the control mechanism to be in equilibrium at extremes of the mechanical cycle, i.e., when one chamber is charged and the other is vented. On this over-center phenomenon occurring, the control mechanism resists charging or venting and, on occasion, actual stalling can occur. Moreover, especially at low cyclical rates, these prior systems tend to exhibit surging as the system lurches from one condition to another which degrades pumping efficiency and negatively affects the ultimate use object of the system. In an attempt to overcome surging, pumps of this kind have been operated at higher than normal fluid pressures which increases the momentum of the control mechanism thereby avoiding over-center failures. However, such high pressure use cannot always be employed, and even if capable of being used presents its own problems common to hydraulic systems generally. Also, surging has been reduced somewhat by reducing the fluid flow rate which reduces forces in the system that counteract control mechanism momentum. All in all, improvement in control mechanisms for diaphragm pumps is a desideratum.

U.S. Pat. No. 4,385,869, Omata, discloses a reciprocation pump consisting of four individual diaphragms cyclically driven by mechanical drive shafts (7) to pump a fluid along a common pipe (3).

U.S. Pat. No. 5,334,003 issued to Gardner pertains to an air valving system in combination with a double diaphragm which uses a bore system to open and close tapped openings to control fluid movement.

The known prior art all appears to be subject to the "over-center" problem, and, therefore, not fully satisfactory in operation under all use circumstances.

SUMMARY OF THE INVENTION

It is therefore a primary aim and object to provide an improved fluid control mechanism for driving a multiple diaphragm pump.

A further object is the provision as in the primary object of a diaphragm pump and fluid control mechanism that has substantially eliminated the over-center tendency to stalling and surging over a wide range of fluid pressures and speed of operation.

In accordance with the practice of the present invention, a control mechanism is provided including a distributor plate sealingly and rotatably mounted onto a porting plate which sequentially supplies a pressurized fluid in timed relation to three or more diaphragms of a diaphragm pump system for flexing each diaphragm to force a pumped fluid along a common discharge conduit.

BRIEF DESCRIPTION OF THE DRAWING

These and other objects of the present invention will become more readily apparent upon reading the following detailed description and upon reference to the attached drawings in which:

FIG. 4 is a top plan view of a first embodiment of control mechanism;

FIG. 5 is an elevational view of the of the control mechanism taken along line 5—5 of FIG. 4;

DESCRIPTION OF PREFERRED EMBODIMENTS

Figure 1:
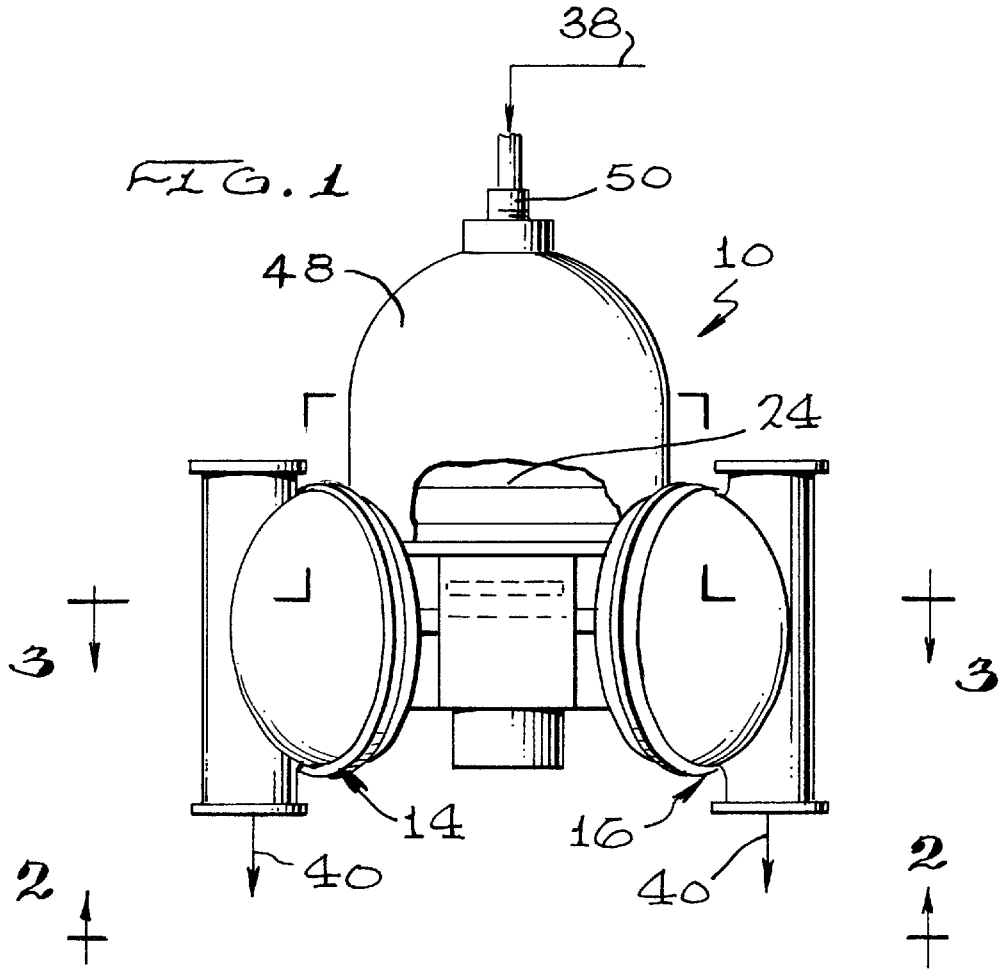
FIG. 1 is a schematic depiction of the overall arrangement of the invention components.
Figure 2:
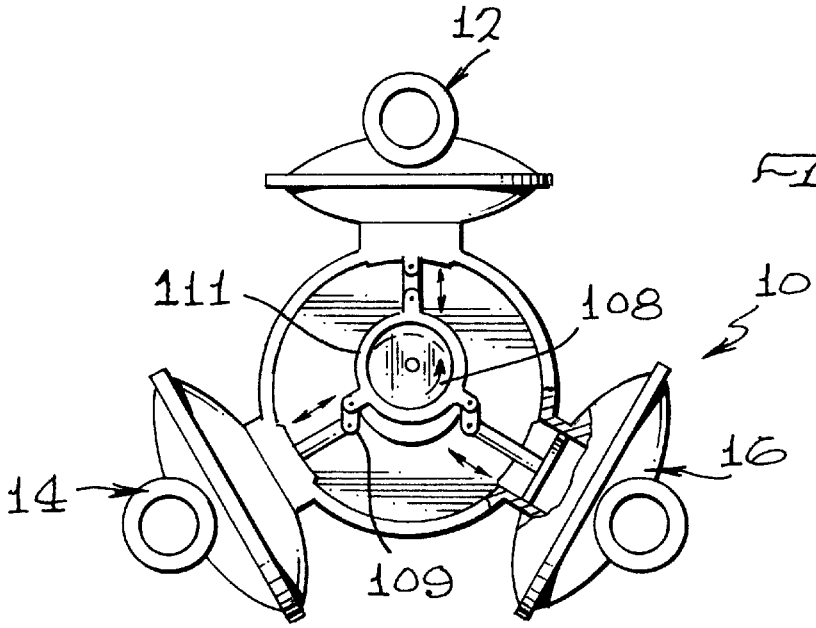
FIG. 2 is an elevational sectional view of a typical diaphragm pump as employed in the invention.
Figure 3:
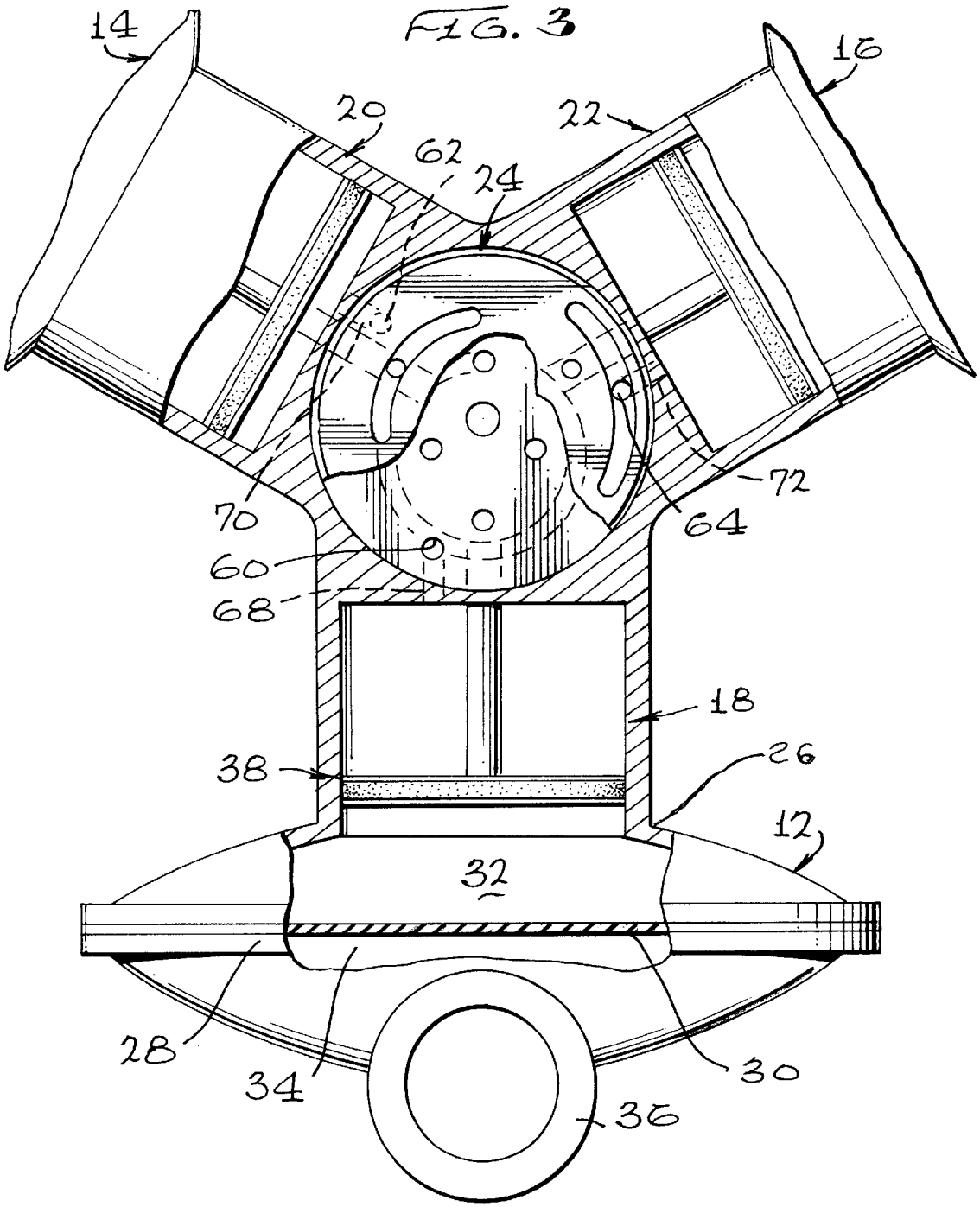
FIG. 3 is a perspective view of a control mechanism for sequentially providing activating fluid to diaphragm pumps.

With reference now to the drawing and particularly FIGS. 1, 2 and 3, the overall system of the invention enumerated generally as 10 is seen to include first, second and third diaphragm pumps 12, 14 and 16, respectively, which are individually driven by first, second and third piston and cylinder pumps 18, 20, and 22 in a way that will be described. Properly timed operation of the piston and cylinder pumps to achieve the advantages of the invention is provided by a control mechanism 24 which, broadly, distributes via the piston and cylinder pumps a pressurized activating fluid to each diaphragm pump in appropriate amounts and at appropriate times.

FIG. 3 shows a typical prior art pump 12 (pumps 14 and 16 can be identical) of the diaphragm category, each of which includes first and second housing parts 26 and 28 having facing edge portions sealingly clamped onto a flexible diaphragm 30 enclosing an entrance chamber 32 and a discharge chamber 34. In use, a pressurized activation fluid (e.g., air) indicated by arrow 38 (FIG. 1) supplied to the entrance chamber 32 distends the flexible diaphragm 30 which compresses a second or further fluid to be pumped (arrow 40, FIG. 1) causing it to discharge from the chamber 34 into a common discharge conduit 36. Typically, the fluid to be pumped is more dense than the activation fluid and may also be more viscous (e.g., syrup). On the chamber 34 discharging fully and the activation fluid pressure returning to an initial low pressure, the diaphragm 30 resumes the central position shown for a new operational cycle. The three diaphragm pumps 12–16 serially discharge into a single outlet conduit 36 to provide a single stream of pumped fluid.

Turning now to FIGS. 4–5, the control mechanism 24 includes in its major parts a distributor plate 42 and a porting plate 44, both of generally cylindrical disclike geometry and preferably having substantially contiguous outer edges. By virtue of an axle 46 extending through the center points of both plates 42 and 44, the plates are joined together for relative rotation and are in sealed, face-contacting relation throughout operation. The control mechanism is mounted within a hermetically sealed housing 48 (FIG. 1) with the axle extending generally vertically and the distributor plate mounted onto the upper surface of the porting plate. The pressurized activation fluid (e.g., air) for providing timed operation of the described system is supplied to the housing at an inlet fitting 50 which serves to force the two plates 42 and 44 into a face-contacting sealing arrangement. Moreover, as will be described in further detail, the control mechanism provides the activation fluid in a timed sequence to the piston and cylinder pumps 18–22 which, in turn, coacts with the control mechanism to drive the diaphragm pumps 12–16.

For a description of a first embodiment of the control mechanism 24, reference is made to FIGS. 4 and 5, where it is seen that the mechanism includes in its major parts the distributor plate 42 and porting plate 44, both adapted for common mounting onto the central axle 46 for relative rotative motion. A circular segment portion is removed from the distributor plate to provide an outer edge camming gap 52. The upper surface 54 of the distributor plate is otherwise smooth and flat while the opposite or lower surface consists of a flat outer rim surface 56 completely enclosing a central shallow opening 58 enabling ready fluid communication throughout the entire opening 58.

The porting plate 44 has a flat upper surface (facing plate 42) of substantially the same diameter as that of the distributor plate. A first set of three openings 60, 62 and 64 are arranged at a common radius R1 from the central opening 66 and angularly disposed at 120 degrees to each other. Each of the individual openings 60–64 is interconnected, respectively, by a conduit 68, 70 and 72 to communicate with a cylinder inner end portion of a piston and cylinder pump 18, 20 or 22 (FIG. 3). A second set of three openings 74, 76 and 78 is formed in the porting plate at a common diameter R2 (which is less than R1) from the central opening 66 and all interconnected to an external low-pressure exhaust sump (not shown).

In operation of the first embodiment of control mechanism 24, on rotating the distributor plate about the axle 46 with the porting plate fixedly positioned, the camming gap 52 moves along a circle of centerline diameter approximately R1 such that the openings 60, 62 and 64 are individually and sequentially located within the gap and while there are exposed to pressurized activating fluid that moves along a conduit 68, 70 or 72 to drive the respective pistons from an inner position to an outer one. While any one opening 60–64 is receiving pressurized activating fluid, the other openings in the first set 60–64 are in communication via the shallow opening 58 with the second set of exhaust openings 74–78.

Figure 6:
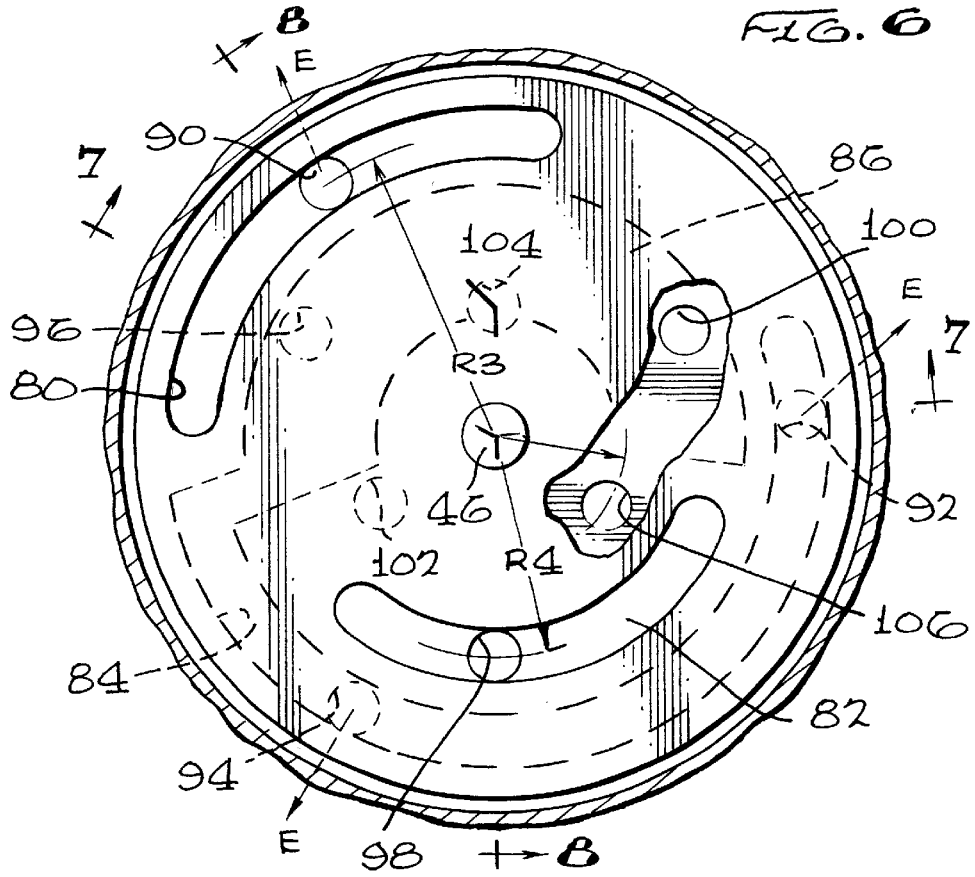
FIG. 6 is a top plan view of a second embodiment of control mechanism.
Figure 7:
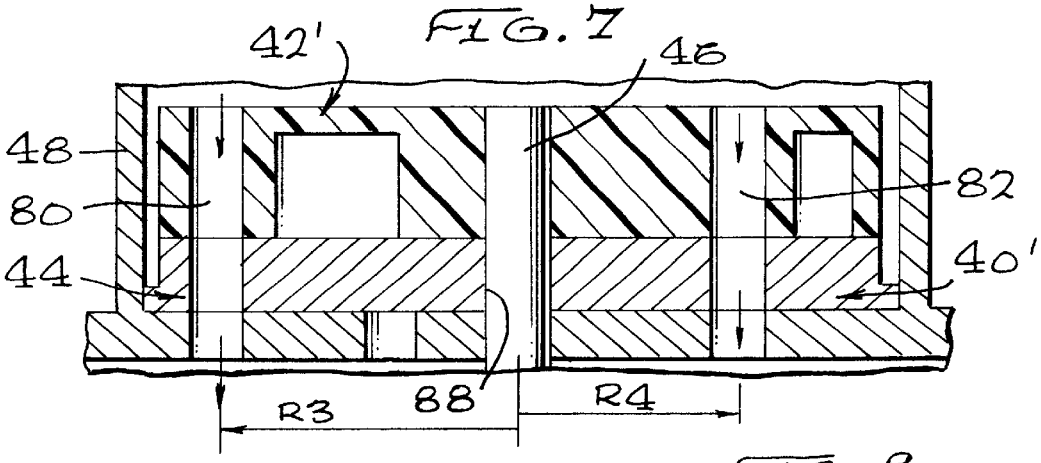
FIG. 7 is an elevational view taken along line 7—7 of FIG. 6.
Figure 8:
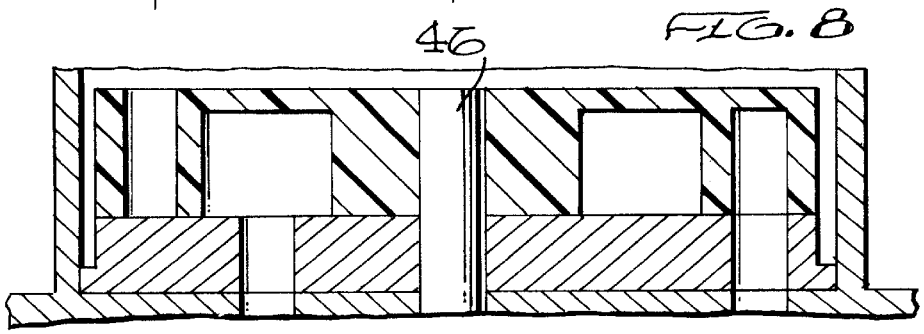
FIG. 8 is a further elevational view similar to FIG. 7 with the plates shifted.
Figure 9:
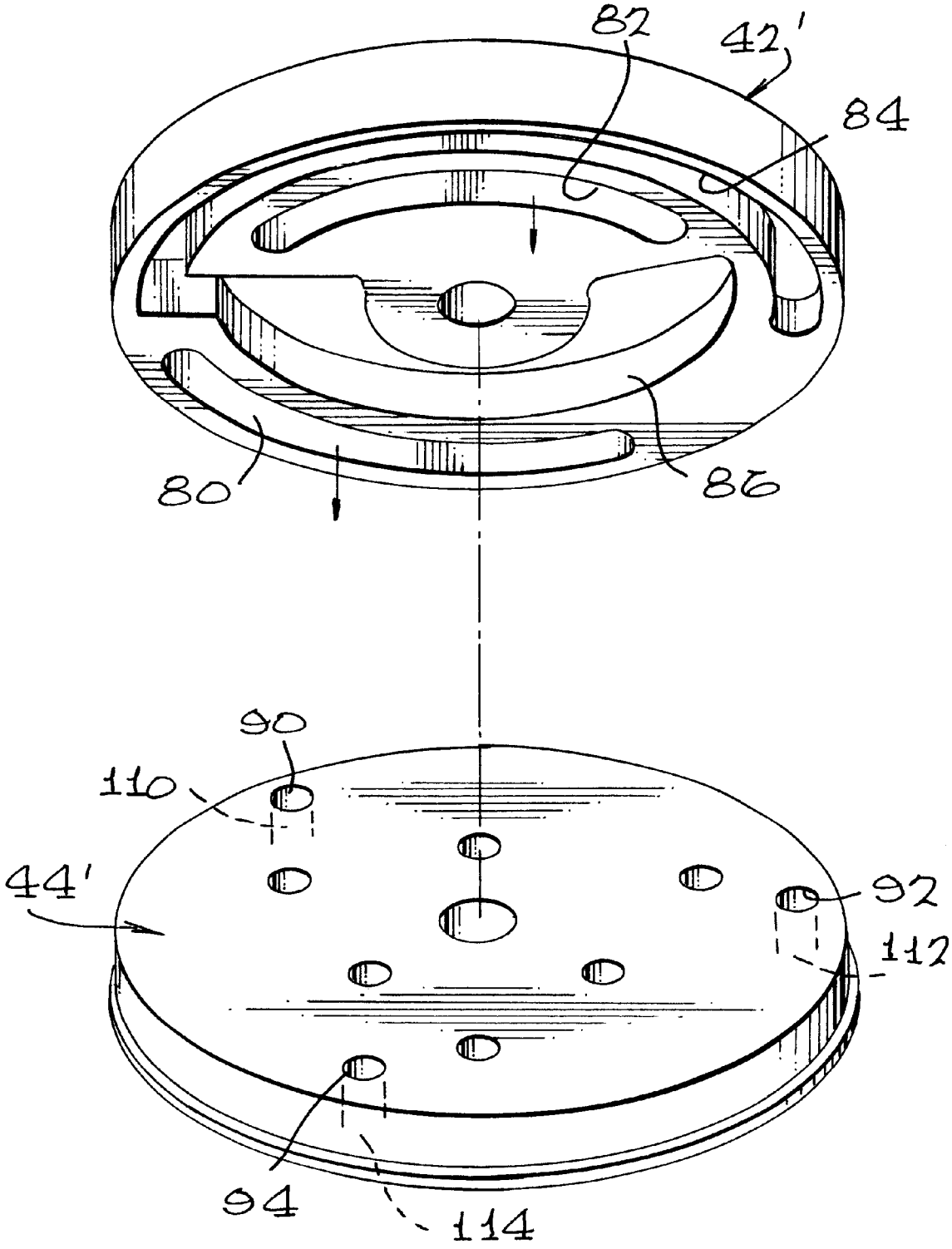
FIG. 9 is an exploded view of the control mechanism of FIG. 6.

For the ensuing detailed description of a second embodiment of the control mechanism 24, reference is made simultaneously to FIGS. 6–8. Where the terms "top" and "bottom" surfaces of the distributor and porting plates are used, they refer to those surfaces as the plates are depicted in FIGS. 7 and 8. The disc-shaped distributor plate 42' includes a first slotted opening 80 of circular segment shape located at a radius R3 from the plate center 46 and lying closely adjacent the plate outer edge. A second circular segment slotted opening 82 is located at a radius R4 that is less than R3 from center 46, and which opening is located generally along the opposite plate edge but lying closer to the center than does opening 80. With reference to FIG. 6, the lower surface of the distributor plate includes a first shallow slot 84 that is generally semicircular and located at the distance R3 from the plate center. A second shallow slot 86 formed in the plate lower surface is wider than slot 84 and located at R4 from center 46. One end of slot 84 communicates with one end of slot 86 providing a common fluid (air) passage throughout the full lengths of both shallow slots.

The porting plate 40' has an opening 88 at its center for receiving the axle 46 therethrough as well as through a center opening in the distributor plate 42' providing rotatability of the two plates with respect to each other. A first set of three openings 90, 92 and 94 are formed in the porting plate 40' at the common distance R3 from the center opening and separated angularly from each other at 120 degrees. A second set of three openings 96, 98 and 100 in the porting plate are located at a common distance R4 from the porting plate center opening 88 and arranged at 120 degree angular spacing from each other. It is to be noted that the openings 96–100 are shifted angularly approximately 45 degrees about the center from the openings 90–94. A third set of three openings 102, 104 and 106 are located at a common distance RS from the center opening 88 which is less than R4 and arranged at 120 degrees from each other.

Before proceeding with the operation of the pneumatic aspects of the invention, attention is directed to the common crankshaft arrangement 108 (FIG. 2) which serves in a way known in the art to synchronize action of the cylinder and piston pumps in a continuous cyclic manner by interconnecting each pump piston shaft via linkage 109 to a common connection ring 111. For example, as shown best in FIG. 3 the piston for pump 18 is at its maximum extension in the cycle, and on continuing the cycle pump 20 will then moves to its maximum extension followed by pump 30 moving to its maximum extension. Accordingly, the cylinder and piston pumps 18, 20 and 22 are individually and cyclically operated in conjunction with each other.

Returning now to the second embodiment control mechanism details, the porting plate 44' is fixedly mounted to the piston and cylinder pumps 18, 20 and 22 assembly such that the porting plate openings 90, 92 and 94 respectively communicate with conduits 110, 112 and 114 leading into the inner end of the individual pump cylinders. By the described construction, in a way similar to that already given in connection with the first embodiment, the pressurized activation air is sequentially applied to the individual cylinder and piston pumps via porting plate openings 90–94 which, in turn, individually drives the associated diaphragm pumps 12–16. The result is a single stream 40 of pulsatingly driven pumped fluid transferred along a single outlet conduit 36 for use in any desired manner. By this construction, operation can be accomplished at reasonable speeds and moderate pressures without encountering over-center stalling or surging.

To initiate operation of the described system, pressurized activation fluid is merely applied to fixture 50 preferably without connection to work fluid, and then when the pumping begins the work fluid is interconnected with the diaphragm pumps.

Although the invention is described in connection with preferred embodiments, it is to be understood that one skilled in the appertaining art may suggest modifications that come within the spirit of the invention as described and within the ambit of the appended claims.

What is claimed is:

1. Apparatus for cyclically and sequentially driving three individual pump diaphragms responsive to a pressurized activation fluid, comprising:

first, second and third piston and cylinder combinations, each combination having a crankshaft connected for movement with the said piston, and all the crankshafts being interconnected for interactive movement;

a porting plate fixedly mounted with respect to said combinations and having first, second and third fluid conduits extending therethrough and individually connected to the corresponding combinations;

a distribution plate having a first major surface in contact with and rotatably mounted with respect to the porting plate and including an opening therein which is aligned during predetermined angular ranges of rotation with each of porting plate conduits; and a source of pressurized activation fluid in communication with a second major surface of the distribution plate.

2. Apparatus as in claim 1, in which the distribution plate includes a first major surface with a first curved shallow slot therein located at a first radius from a center of rotation, and a second curved shallow slot located at a second radius less than the first radius; the porting plate including a first set of three equally spaced apart openings located on a curve at the first radius from the center of rotation and a second set of three equally spaced apart openings provided in a curved path at the second radius from the center of rotation; said first set of openings being connected to the source of pressurized fluid and the second set of openings being connected via respective conduit means to the cylinder and piston combinations.

3. Apparatus as in claim 2, in which a third set of three equally spaced apart openings for pressurized fluid exhaust are formed in the distribution plate located at a third radius from the center of rotation, said third radius being less than said second radius, said third set openings facing toward and sequentially communicating with one of the second set of openings at a time.

4. Apparatus as in claim 1, in which a fixedly mounted axle means extends through the center of rotation and the distribution plate can freely rotate about said axle; said distribution and porting plates being mounted within a housing containing pressurized fluid.

5. Apparatus as in claim 4, in which the axle means extends generally vertically and the first, second and third piston and cylinder combinations are mounted about the axle means in angularly equally spaced relation.

6. Apparatus as in claim 2, in which the distribution and porting plates are mounted within a hermetically sealed housing provided with a supply of pressurized activation fluid.

7. Apparatus as in claim 6, in which the distribution slots and porting openings are so arranged as to produce synchronized drive of the piston and cylinder combinations sequentially by the pressurized activation fluid.

* * * * *